US005957314A

United States Patent [19]

Nishida et al.

[11] Patent Number: 5,957,314

[45] Date of Patent: Sep. 28, 1999

[54] CROWN CAPS FOR DRUG CONTAINERS

[75] Inventors: Hirotaka Nishida, Minoo; Kouiti Yoshimi, Takatsuki; Keiji Hamamoto, Osaka, all of Japan

[73] Assignee: Taisei Kako Co., Ltd., Osaka, Japan

[21] Appl. No.: 08/973,423

[22] PCT Filed: Oct. 1, 1996

[86] PCT No.: PCT/JP96/02854

§ 371 Date: Dec. 8, 1997

§ 102(e) Date: Dec. 8, 1997

[87] PCT Pub. No.: WO97/37902

PCT Pub. Date: Oct. 16, 1997

[30] Foreign Application Priority Data

Apr. 9, 1996 [JP] Japan ..... 8-112005

[51] Int. Cl.[6] ..... B65D 41/20; B65D 41/62

[52] U.S. Cl. ..... 215/249; 215/275; 220/257; 220/359.2; 220/359.4

[58] Field of Search ..... 215/247, 249, 215/224, 275, 277, 293, 317, 232, 251; 220/320, 359.1, 359.2, 359.3, 359.4, 258, 257, 256, 254, 359.5

[56] References Cited

U.S. PATENT DOCUMENTS

| | | | |
|---|---|---|---|
| 3,888,377 | 6/1975 | Stadler | 215/249 |
| 4,254,884 | 3/1981 | Maruyama | 215/247 X |
| 5,085,332 | 2/1992 | Gettig et al. | 215/249 |
| 5,269,429 | 12/1993 | Schumacher | 215/274 X |
| 5,303,835 | 4/1994 | Haber et al. | 215/274 X |
| 5,314,084 | 5/1994 | Folta et al. | 215/249 |
| 5,316,163 | 5/1994 | Von Schuckmann | 215/249 |
| 5,379,908 | 1/1995 | Rohe | 215/249 |
| 5,421,469 | 6/1995 | Lee | 215/247 X |

FOREIGN PATENT DOCUMENTS

| | | |
|---|---|---|
| 54-118363 | 8/1979 | Japan . |
| 63-82753 | 5/1988 | Japan . |
| 63-88963 | 6/1988 | Japan . |
| 1161455 | 11/1989 | Japan . |

*Primary Examiner*—Stephen K. Cronin
*Assistant Examiner*—Nathan Newhouse
*Attorney, Agent, or Firm*—Leydig, Voit & Mayer Ltd.

[57] ABSTRACT

A rubber gasket is closely sealed by integrally connecting a removable close-fastening ring to a top board of a crown-like member to be fitted to a mouth portion in which a liquid drug is kept and pulling down the close-fastening ring to cover the outer periphery of the crown-like member.

11 Claims, 11 Drawing Sheets

(A)

(B)

CROWN CAPS FOR DRUG CONTAINERS

TECHNICAL FIELD

The present invention principally relates to a crown cap for a drug container suitable for preventing any contamination of a mouth plug of the container. More specifically, the present invention pertains to a crown cap for a drug container which is designed in such a manner that a close-fastening ring is integrally connected to the upper portion of a crown-like member, then the crown-like member is externally fitted into a mouth portion of a container, the crown-like member is cut off by pulling down the upper close-fastening ring toward the side of the container and the crown-like member thus cut off is closely fastened to the mouth portion of the container.

BACKGROUND ART

A container for containing drugs has conventionally been designed in such a manner that a drug-passage at a mouth portion of the container is closed with a rubber plug sufficiently sterilized and the container is simultaneously provided with a means for locking the rubber plug at the periphery of the mouth portion to thereby prevent any deterioration or quality-reduction of the drug or the like due to, for instance, air which flows into the container through the loosened portions for a push-fitted portion of the rubber plug and narrow gaps formed between the rubber plug and the mouth portion of the container in order to manage and transport a liquid content (drug) of a container while attending to sanitation. For instance, when a rubber plug is fitted into the mouth portion of a container containing a solution for injection, the rubber plug is push-fitted into a calking and fixing cap of, for instance, aluminum so that the cap and the rubber plug can protect the injection solution from any contamination of dust.

When a rubber plug is held in a caulking cap of aluminum and the rubber plug is inserted into the mouth portion of the container as discribed above, however, the drug solution inevitably comes in contact with the rubber plug. This may occasionally lead to dissolving of additives included in the rubber plug into the drug solution, formation of rubber waste and absorption and/or adsorption of drug components present in the solution on the rubber plug. For this reason, improvement of such a sealing means has been desired in order to ensure high quality of liquid drugs.

To solve the foregoing problems, there has been proposed a rubber plug having a surface coated with a fluoroplastics. Although such a fluoroplastic coating layer permits an increase in the hardness of the surface, it is often accompanied by the formation of wrinkle-like grooves during molding. Therefore, such a structure that a rubber plug is restrained by a caulking cap is insufficient in the tightening force and accordingly, a problem arises, that it is difficult to ensure sufficient sealing performance when the rubber plug is inserted into the mouth portion of a container.

Moreover, a container for keeping, for instance, a drug is mainly formed from a glass material and is fitted with a rubber plug for the purpose of sealing the container and a cap produced from, for instance, aluminum to prevent the rubber cap from falling off. Recently, it has become the general trend to make such a law that such a drug container should be disassembled and divided into combustible and incombustible parts after using the drug kept therein and prior to discarding the used container, from the viewpoint of environmental protection. Under such circumstances, there is a movement to replace glass containers as such drug containers with plastic ones in order to eliminate the need for the disassembly and classification of the waste after using them. However, it would still be necessary to remove the cap formed from, for instance, aluminum prior to discarding it, in spite of such change of materials.

SUMMARY OF THE INVENTION

The present invention has been developed while taking into consideration the foregoing situation and it is thus an object of the present invention to provide a crown cap capable of maintaining sufficient sealing performance of a container, reducing the interaction between a drug as the content of the container and a rubber material as low as possible and ensuring sealing of the opening of the container-mouth portion.

It is another object of the present invention to provide a crown cap which can entirely be discarded as a combustible material.

The crown cap of the present invention is provided with a locking mechanism so that, even when a container is closed with the cap through a plate-like rubber gasket to be pressed onto the open end of the mouth portion, the plate-like rubber gasket can certainly be pressed against the opening of the container-mouth portion. In this case, the rubber gasket for covering the mouth portion of the container is previously fitted to the crown cap side. Such a structure of the crown cap permits the closure of the opening of the container-mouth portion with certainty since the crown cap is peripherally pressed by the action of the locking mechanism to thus exert a high close-fastening force on the container.

The crown cap of the present invention is provided with a close-fastening ring which is formed in a freely removable manner on an upper portion of a crown-like member covering an upper portion of a rubber plug, in order to fasten the crown-like member by pressing the periphery thereof toward the inner side of the mouth portion, in which the close-fastening ring is separated from the crown-like member at an instance when the ring is forced down towards the side the mouth to thus fit the close-fastening ring to the outer periphery of the crown-like member.

Moreover, the crown cap of the present invention is designed so that an opening is formed on the top board of the crown-like member, the opening is in general closed by a removable closing body such as a rod-like body or a ring for finger-hooking (hereinafter referred to as "finger-hook ring") and that the rubber gasket can be exposed by removing the closing body to thus take out the contents of the container.

In addition, the rubber gasket may be fitted, in advance, to the crown-like member through the use of a fixing means such as projections or the use of an adhesive so that the rubber gasket is not disconnected from the crown-like member when fitting the crown cap to the container.

Moreover, a container provided with the crown cap of the present invention can completely be formed from combustible materials if the container itself is formed from a thermoplastic resin and the crown cap, closing body and close-fastening ring are also produced from thermoplastic resins.

DESCRIPTION OF PREFERRED EMBODIMENTS

Embodiments of the present invention will hereinafter be described in more detail with reference to the accompanying drawings.

Figure 1:
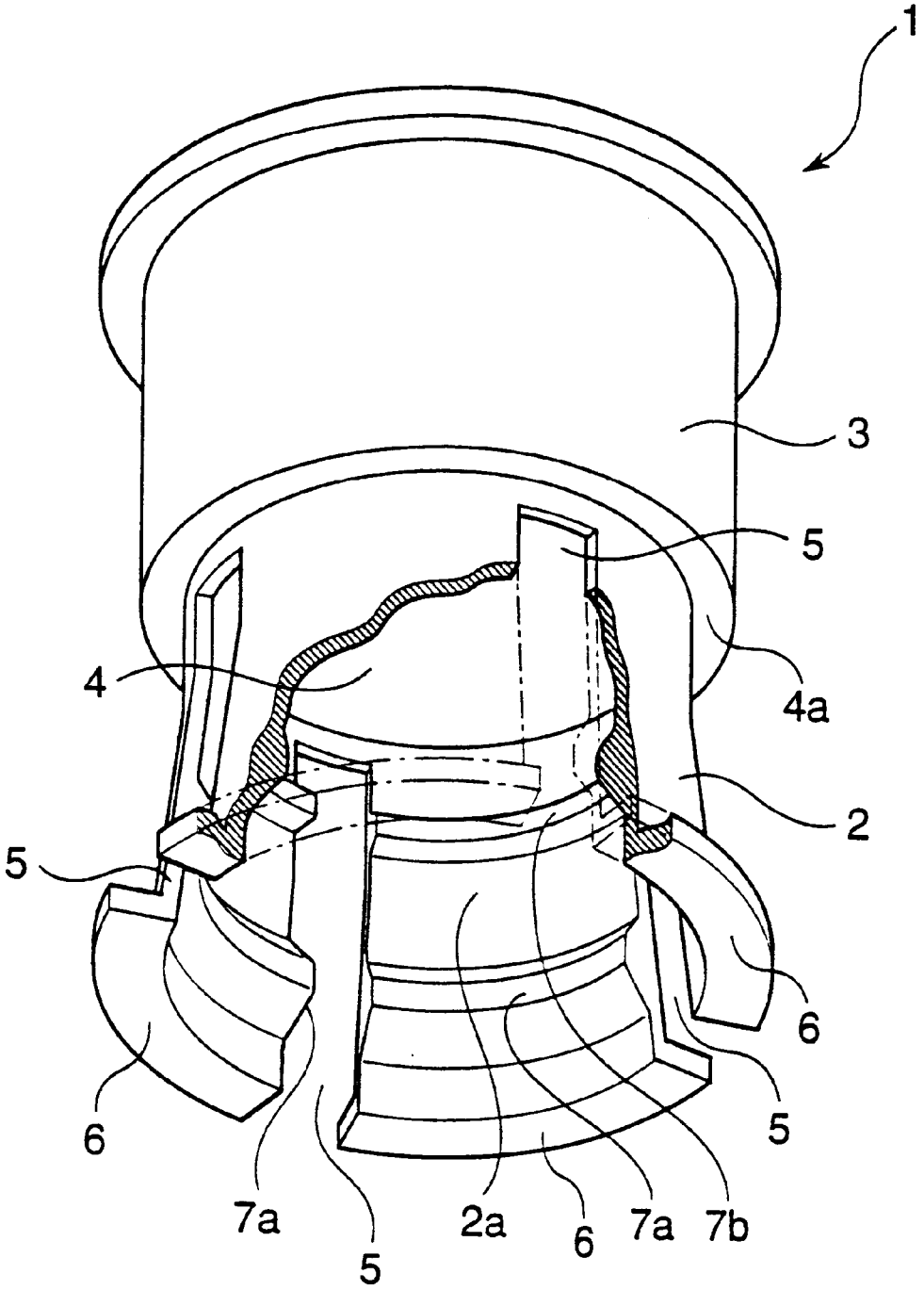
FIG. 1 is a perspective and partially broken view showing a crown cap according to a first embodiment of the present invention.
Figure 2:
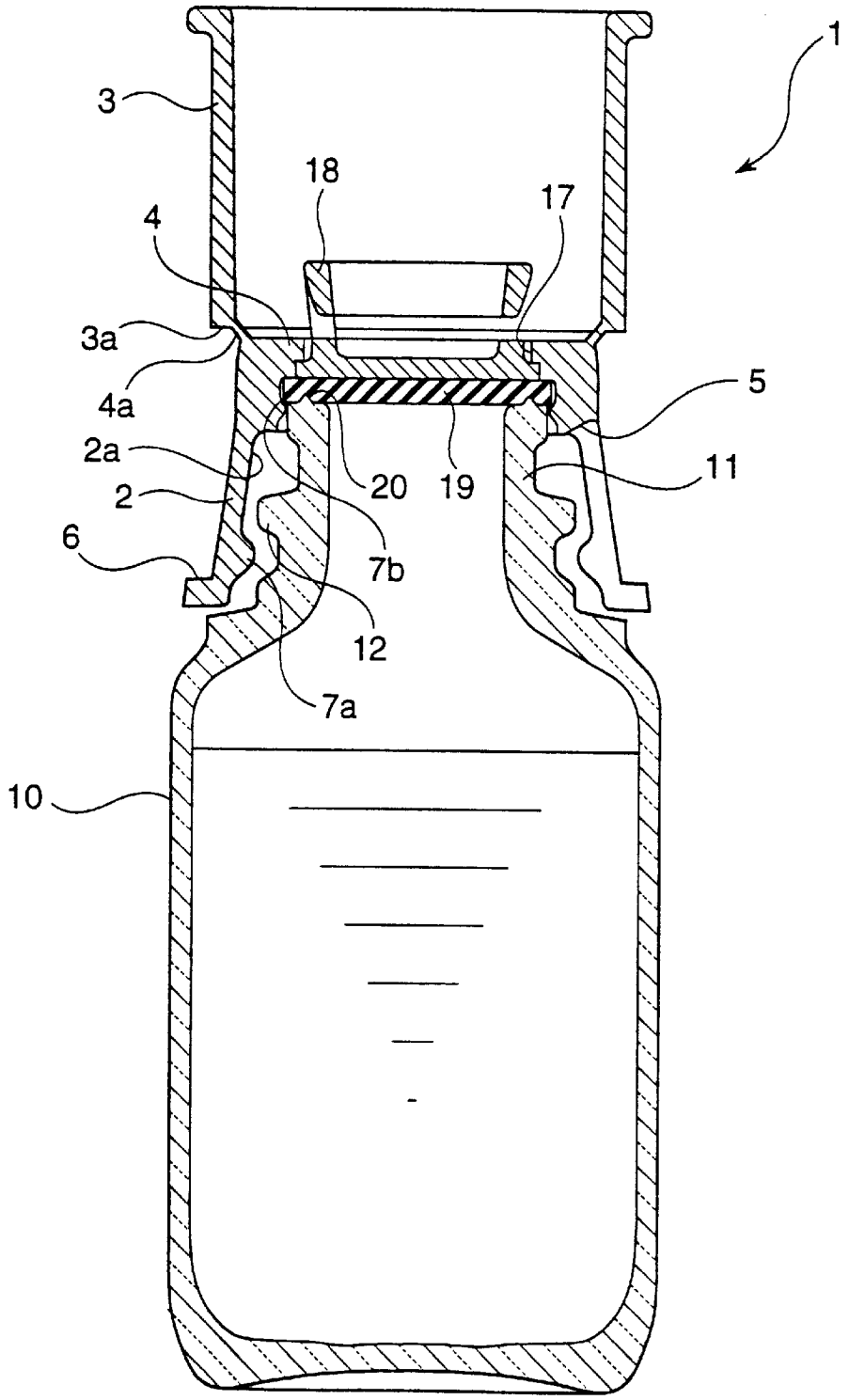
FIG. 2 is a cross sectional view showing the crown cap according to the first embodiment of the present invention, which is placed on a container.

FIG. 1 is a perspective and partially broken view, seen from the bottom, of a crown cap according to a first embodiment of the present invention and FIG. 2 is a vertical section of a container to which the crown cap shown in FIG. 1 is fitted.

In this embodiment, the crown cap 1 comprises two closed-end cylindrical bodies 2, 3 which are united into one body such that they are put one on top of the other while the top board 4 serving as the boundary therebetween is positioned at the center of these cylindrical bodies.

The lower cylindrical body 2 (positioned on the side of a container 10) constitutes a crown-like member 2 which is fitted to the container 10 in such a manner that it surrounds the periphery of the mouth portion 11 of the container. On the other hand, the other cylindrical body 3 (upward positioned) constitutes a close-fastening ring 3 which makes the fitting of the crown-like member 2 to the container solid. The close-fastening ring 3 can be fitted to the outer periphery of the crown-like member 2 as will be detailed below by cutting off the ring at the peripheral edge 4*a* of the top board 4, the edge portion 4*a* being designed to have a small thickness so as to be easily cut off.

A plurality of slits 5 are formed on the periphery of the crown-like member 2 at equal intervals. In addition, circular projected portions 7*a*, 7*b* are formed on the inner surface of the crown-like member 2, and the lower projected portion 7*a* is engaged with the mouth portion 11 of the container at the lower end of a flange 12, as will be discussed below in more detail. Moreover, when fitting a rubber gasket 19 to the crown cap, the gasket is engaged with the upper projected portion 7*b* at the periphery thereof such that the latter member serves as a fixing means for preventing the rubber gasket 19 from falling off the top board 4. The presence of such a projected portion 7*b* permits the support of the disc-like rubber gasket 19 to hold it within the crown-like member 2. The projected portion 7*b* for supporting and fixing the rubber gasket 19 does not necessarily have a circular shape and it may be in the form of a plurality of projections arranged along a circumference.

Furthermore, an overhanging portion 6 is formed on the lower peripheral edge of the crown-like member 2.

A circular opening 17 is formed at the center of the top board 4 and a closing body 18 having a ring serving as a finger-hook is freely removably fitted into the opening 17. In this respect, the edge portion of the closing body 18 and the end surface of the opening 17 are designed to have shapes so as to be engaged with each other. For this reason, the closing body 18 is closely fitted to the opening when the body 18 is pressed into the opening 17.

A triangular projection 20 is formed on the upper end surface of the mouth portion 11 in order to prevent any slippage of the position of the rubber gasket 19. The triangular projection 20 may be partially or completely formed along the circumference the same as in case of the projected portion 7*b*. This can accordingly prevent any slippage of the rubber gasket 19 in the lateral direction on the mouth portion 11 and also permits the formation of a 20 sufficient thrust to thus further improve the sealing performance thereof.

The crown cap 1 is formed from a thermoplastic resin capable of being handled as a combustible material. In addition, the rubber gasket 19 is naturally a combustible material.

Therefore, if the container 10 to which the crown cap 1 is fitted is not made of a glass but is formed from a combustible material such as a thermoplastic resin, the resulting container provided with the crown cap can entirely be handled as a combustible material.

The operation of the crown cap 1 will be explained.

First of all, the plate-like rubber gasket 19 is secured to the top board of the crown-like member 2 prior to the fitting of the crown cap 1 to the container 10. In this regard, the projected portion 7*b* is formed on the inner surface of the crown-like member 2 and the lower periphery of the rubber gasket 19 is supported by and fixed to the projected portion 7*b* when the rubber gasket 19 is engaged in the concave portion defined around the inner surface of the crown-like member. Thus, the projected portion 7*b* can prevent any removal of the rubber gasket 19 from the crown-like member 2 and accordingly, the rubber gasket 19 never falls off therefrom.

The container 10 is filled with a drug for injection and then the crown cap 1 to which the rubber gasket 19 is secured as described above is fitted to the container 10 at the mouth portion 11. In this respect, the rubber gasket 19 is made from, for instance, butyl rubber, the surface of which may be coated with a fluoroplastic. The rubber gasket 19 provided with a coated film of a fluoroplastic has excellent resistance to chemical attack. This rubber gasket 19 is preferably used after sufficiently sterilizing by, for instance, heating at 121° C. for 20 minutes.

Figure 3:
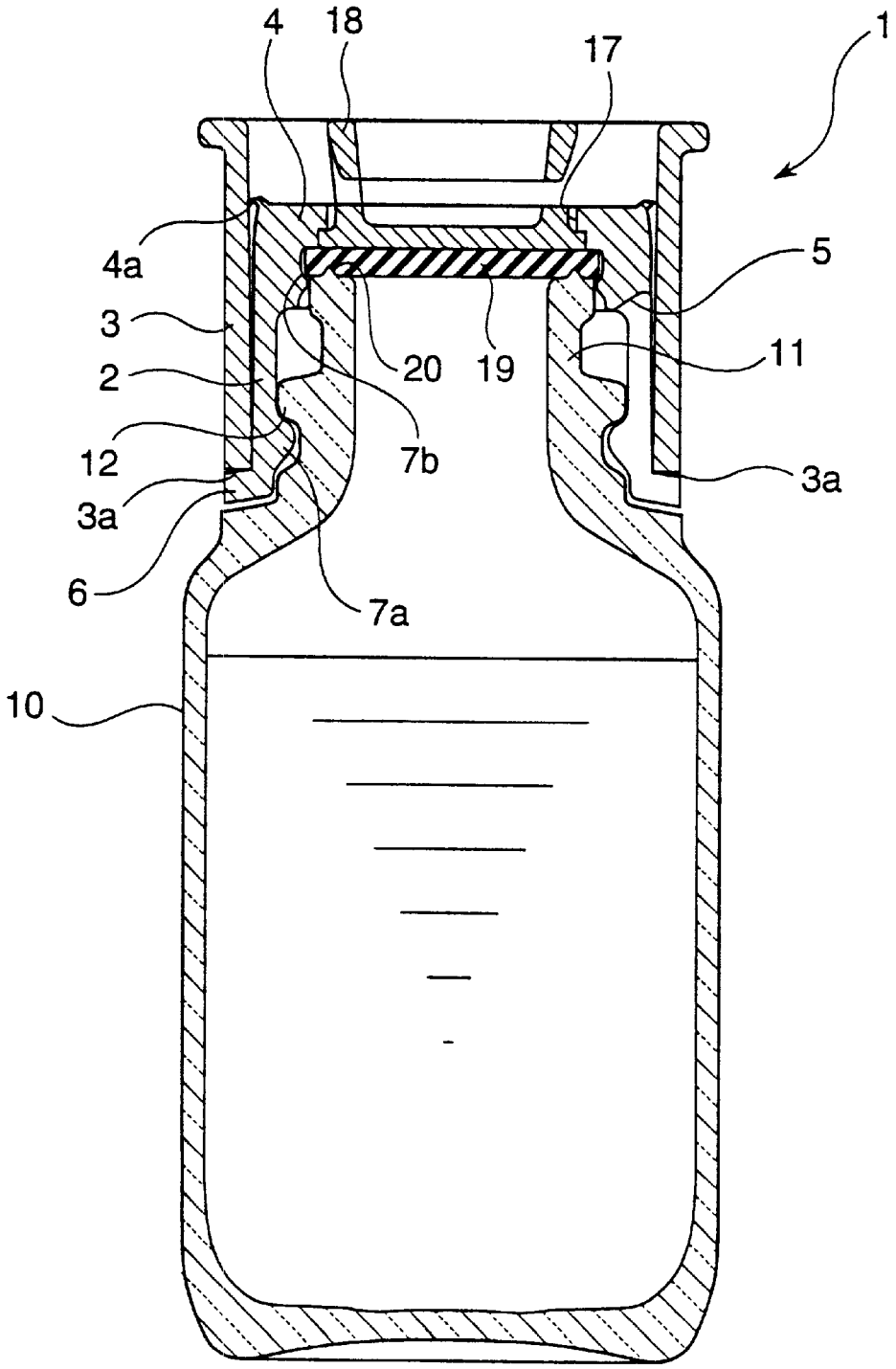
FIG. 3 is a cross sectional view showing the crown cap according to the first embodiment of the present invention, which is completely fitted to the container.

When fitting the crown cap 1 to the container 10 according to the manner as described above, the crown-like member 2 can easily be fitted to the outer periphery of the mouth portion 11 because of the presence of slits 5 which are formed on the periphery of the crown-like member 2 at equal intervals. More specifically, the slits 5 are outward expanded to thus enlarge the diameter of the crown-like member 2 and accordingly, the lower projected portion 7*a* formed on the inner periphery of the crown-like member 2 can descend down to the level below the flange 12 of the mouth portion 11. Thus, the triangular projection 20 can prevent any slippage of the rubber gasket 19 and the latter is relatively strongly pressed against the mouth portion 11 because of the engagement between the projected portion 7*b* of the crown-like member 2 and the flange 12 of the mouth portion 11, as shown in FIG. 3.

After fitting the crown-like member 2 positioned on the lower side of the crown cap 1 to the mouth portion 11 of the container 10 as explained above, the upper close-fastening ring 3 is then downwardly pressed toward the container 10 manually or using an appropriate tool. Thus, the close-fastening ring 3 is separated from the crown cap at the outer peripheral edge 4*a* having a small thickness and slides along the outer surface of the crown-like member 2 to thus cover the outer surface thereof. Consequently, the rubber gasket 19 is maintained in a condition pressed downward and inward.

When the close-fastening ring 3 is pushed down to the desired lower level in the course of pressing the ring 3 toward the container 10, the lower end 3*a* of the close-fastening ring 3 closely contacts with the overhang portion 6 of the crown-like member 2. This accordingly prevents the close-fastening ring 3 from being pushed down any further and the ring 3 inwardly presses the crown-like member 2 strongly. At this stage, the projected portion 7*a* formed on lower inner periphery of the crown-like member 2 is engaged with the flange 12 formed on the mouth portion 11 of the container 10 and thus these three components, i.e., the container 10, the crown-like member 2 and the close-fastening ring 3 are closely fitted to one another. For this reason, the rubber gasket 19 is strongly pressed and thus there are scarcely observed any disengagement of these components or members and/or any slippage in the positions at which they are engaged. Moreover, the rubber gasket 19 is sufficiently compressed and forced down and accordingly, the gasket 19 which usually has a thickness of about 3 mm is deformed to a thickness of about 2.5 mm due to the compression.

The container 10 to which the crown cap 1 is fitted in a closely fastened condition as described above can be managed and transported while preventing with certainty any leakage of a liquid drug from the container. When practically using the same, the closing body 18 can be separated from the top board 4 by pulling the closing body 18 provided with a finger-hook ring. Accordingly, an opening 17 is formed through the top board 4 and this permits the exposure of the top surface of the underlying rubber gasket 19. At this stage, the rubber gasket 19 is sandwiched between the lower surface of the top board 4 and the triangular projection 20 and also firmly compressed therebetween and therefore, the gasket 19 never falls into the interior.

In such a condition, the liquid drug kept in the container can be withdrawn from the container 10 by putting a needle of a syringe through the rubber gasket 19 and the opening 17.

As described above, in the crown cap of this embodiment, the crown-like member 2 is pushed down and the lower projected portion 7*a* thereof and the flange 12 of the container 10 are engaged with one another to fit the cap to the container while compressing the rubber gasket 19 as an elastic material. This accordingly ensures a sufficient sealing force at the contact surface between the rubber gasket 19 and the mouth portion 11 of the container 10 and there is not observed any inflow of air nor any leakage of, for instance, the drug kept in the container through the contact surface.

Such a crown cap may not only be used in containers for keeping injectable liquids but also effectively used in those for keeping drugs which must be lyophilized. More specifically, the cap of a container for keeping drugs to be lyophilized should be maintained in a half-opened condition immediately before the lyophilization, but such a condition can easily be realized if using the crown cap according to the present invention.

In the foregoing embodiment, the projected portion 7*b* is formed on the inner surface of the crown-like member 2 so that the rubber gasket 19 can be kept in the state wherein the rubber gasket 19 is fitted to the crown-like member 2, but the rubber gasket 19 may, instead, be fixed to the top board 4 through an adhesive layer or by fusion-bonding with heating. When the rubber gasket 19 is fixed in such a manner, it is necessary that the adhesive layer formed by an adhesive or by fusion-bonding with heating is easily broken and the closing body 18 provided with the finger-hook ring is removed therefrom when pulling the closing body 18. In this regard, the rubber gasket 19 may partially be adhered or thermally fusion-bonded in order to improve the release properties.

Figure 4:
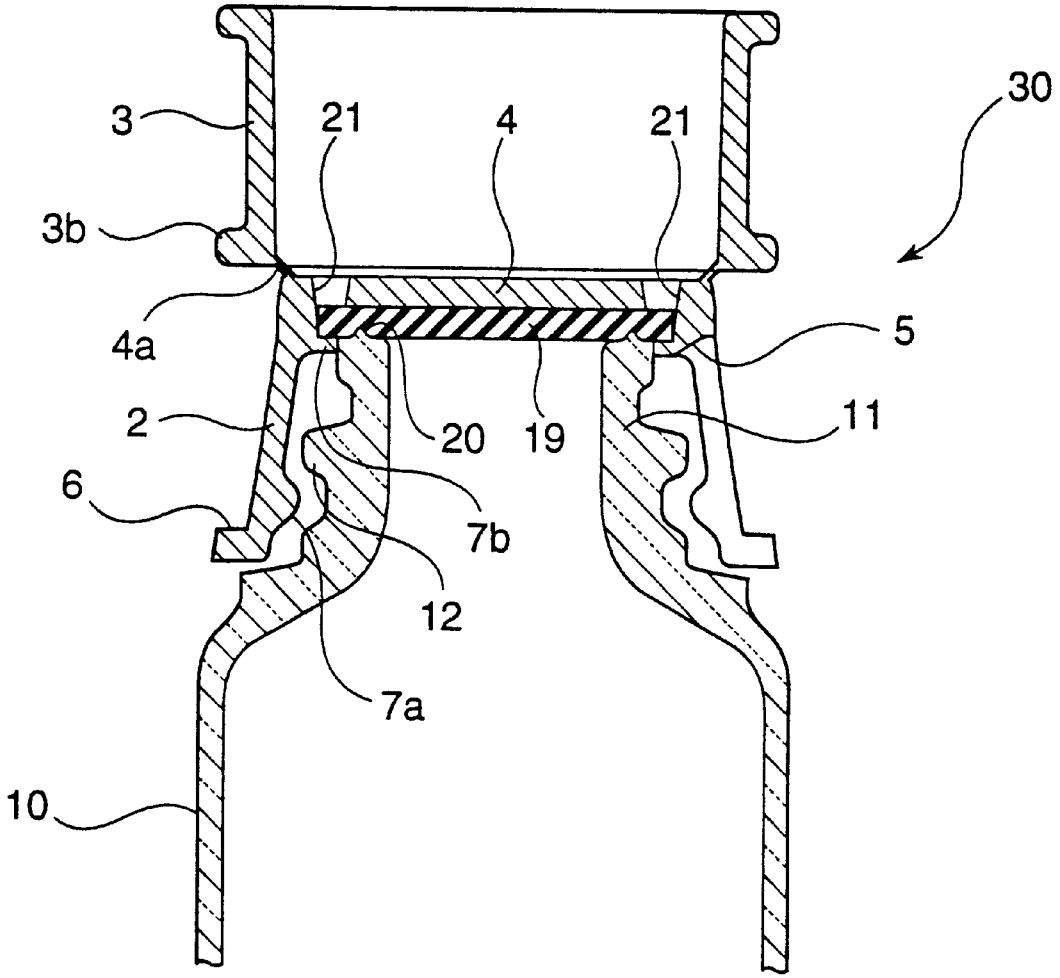
FIG. 4 is a cross sectional view showing the crown cap according to a second embodiment of the present invention, which is placed on a container.
Figure 5:
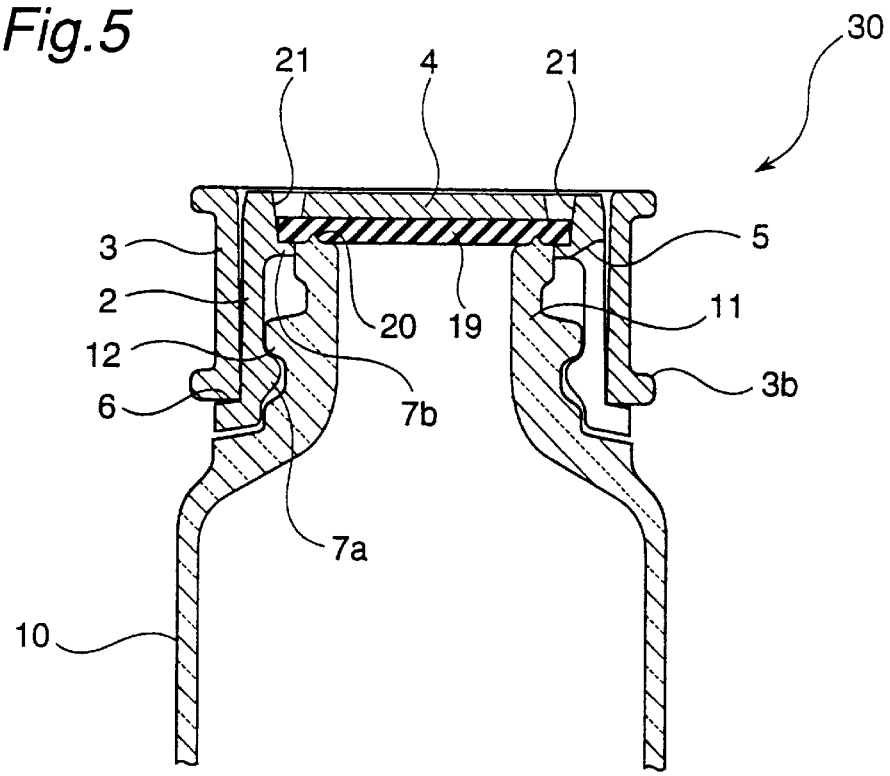
FIG. 5 is a cross sectional view showing the crown cap according to the second embodiment of the present invention, which is completely fitted to the container.

Moreover, a plurality of notched portions 21 may be formed on the top board of the crown-like member 2 as seen from FIGS. 4 and 5. The establishment of such notched portions 21 would permit projection into the notched portions 21 of a part of the rubber material expanded when the close-fastening ring 3 is put on the outer periphery of the crown-like member 2 and the rubber gasket 19 is then compressed. This in turn permits external release of a part of the stress acting on the rubber gasket 19.

In case of such a crown cap 30, the liquid drug kept in the container can be taken out by removing the close-fastening ring 3 and then penetrating a needle of a syringe into the container through the rubber gasket 19.

Furthermore, a flange 3B for reinforcement may be formed on the lower end of the close-fastening ring 3, as shown in FIGS. 4 and 5.

Figure 6:
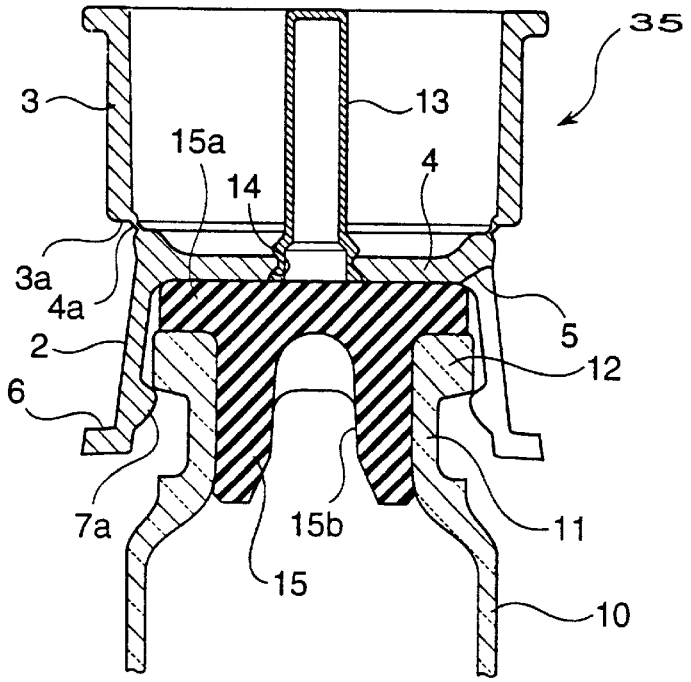
FIG. 6 is a cross sectional view showing the crown cap according to a third embodiment of the present invention, which is placed on a container.

In the foregoing embodiments, the closing body 18 provided with the finger-hook ring is fitted to the top board 4 of the crown-like member 2, but it is also possible to form an opened portion 14 having a small diameter and to vertically stand a rod-like body 13 through the opened portion 14 as seen from FIG. 6. In case of the crown cap 35 wherein the rod-like body 13 is fitted in place of the closing body 18 provided with the finger-hook ring, the rod-like body 13 may be pulled out by bending or moving the body back and forth and/or towards the right and left directions. In addition, the close-fastening force observed when such a crown cap 35 is fitted to the container 10 is sufficiently high like the case shown in FIG. 5.

Figure 7:
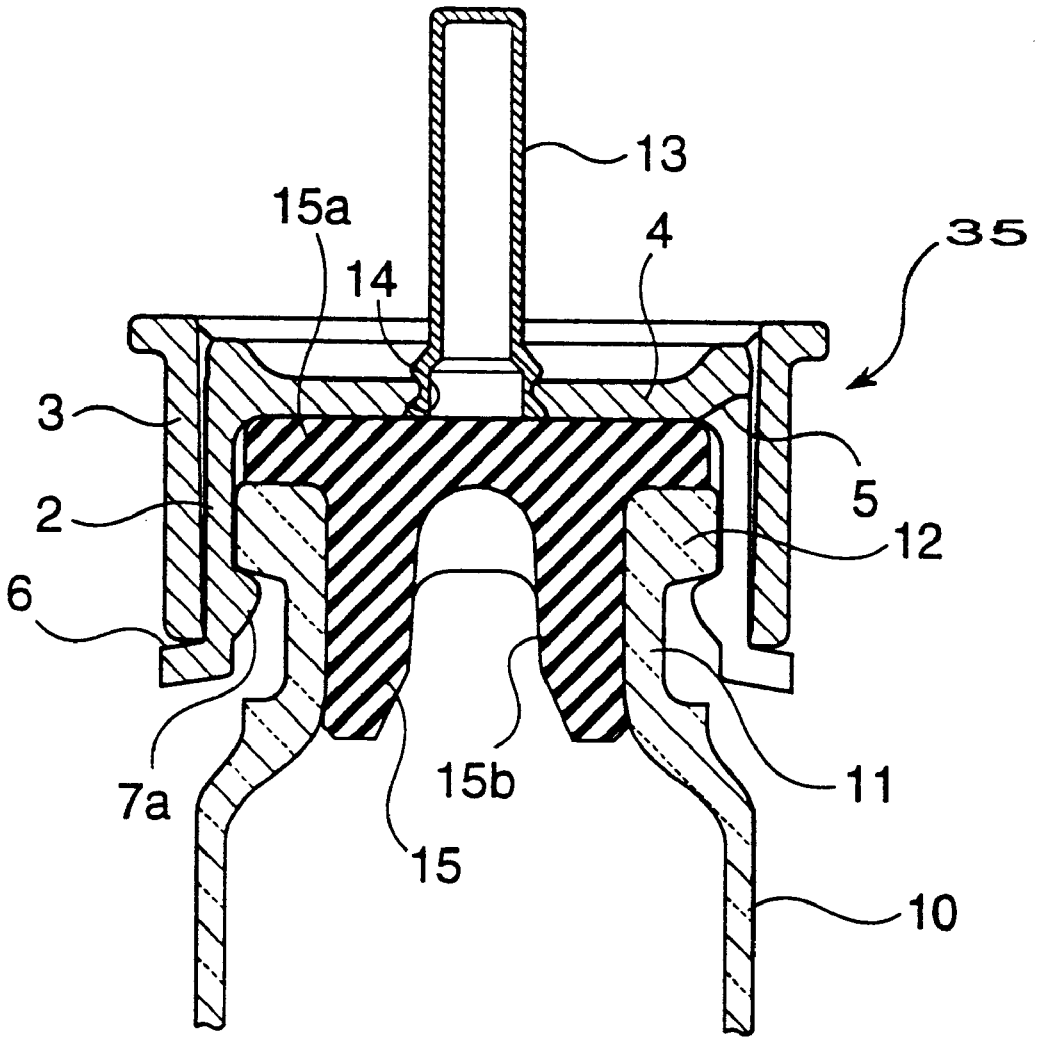
FIG. 7 is a cross sectional view showing the crown cap according to the third embodiment of the present invention, which is completely fitted to the container.
Figure 8:
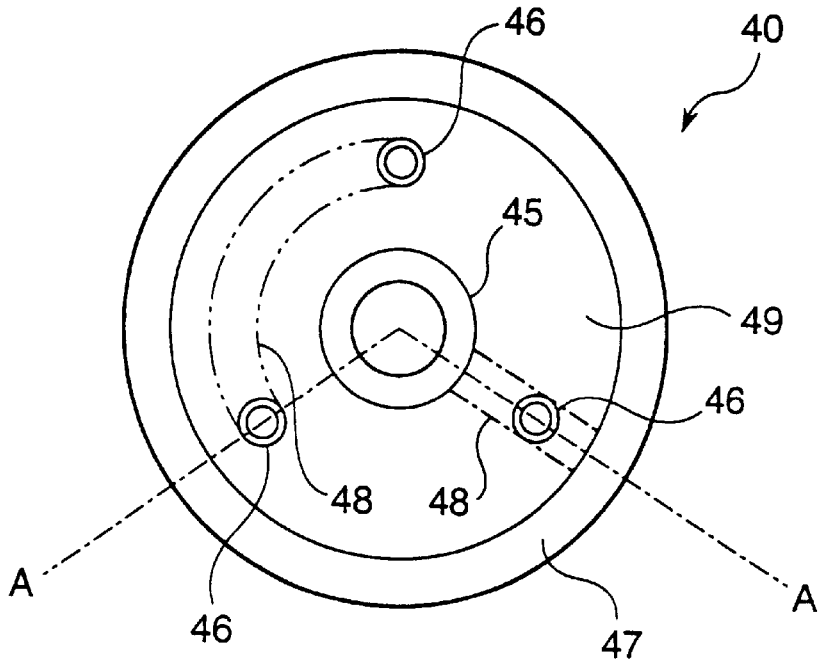
FIG. 8(A) is a bottom plan view of a closing body used in a fourth embodiment and FIG. 8(B) is a cross-sectional view of the closing body taken along line A—A in FIG. 8(A).
Figure 8:
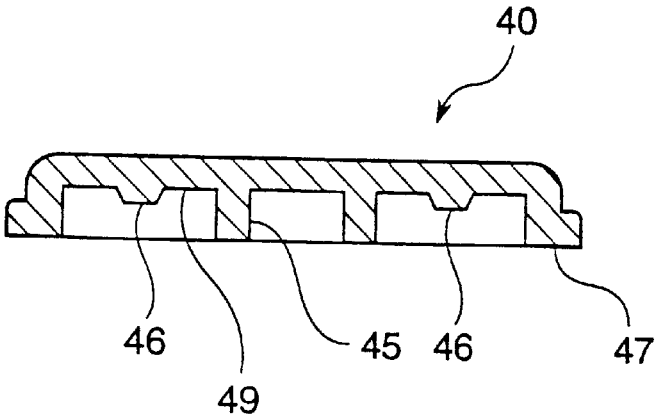

Moreover, the rubber gasket for sealing the passage for drugs is not limited to those having plate-like shapes and may be rubber plug-type 15 ones as shown in FIGS. 6 and 7 wherein the gasket has a cylindrical shape provided with a disk-like portion 15*a* having a large diameter and the lower cylindrical part 15*b* is push-fitted into the mouth portion 11 of the container 10.

In this case, it is not necessary to form the projected portion 7*b* and the triangular projection 20 for holding the rubber plug 15 on the upper end surface of the mouth portion 11 unlike the foregoing embodiments.

In addition, the closing body 18 provided with the finger-hook ring or the rod-like body 13 is formed as parts separated from the top board 4, but a closing body and the top board 4 may be formed in one piece. In such case, the thickness of the portion corresponding to the outer periphery of the opened portion is reduced, the closing body is formed via the thin portion in one piece and subsequently, the thin portion may be broken by applying a force for pushing down the closing body. In this respect, the close-fastening ring 3 and the crown-like member 2 need not be connected over the entire periphery thereof, but may partially be connected to each other. In such case, the thin outer peripheral edges 4*a* may intermittently be distributed on the circumference.

The present invention is not limited to the embodiments discussed above.

FIGS. 8 to 14 show embodiments wherein the crown caps of the present invention are used for other containers for keeping liquid drugs.

Figure 10:
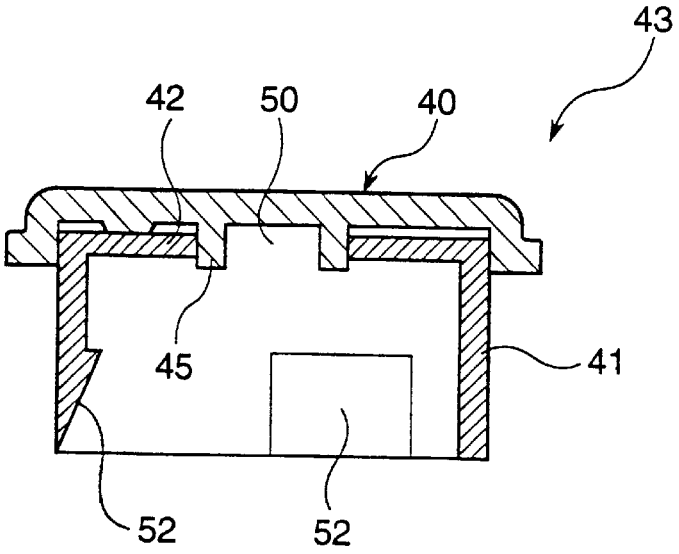
FIG. 10 is a cross sectional view of a cap unit comprising the closing body shown in FIG. 8 and the crown-like member shown in FIG. 9 which are assembled together.
Figure 11:
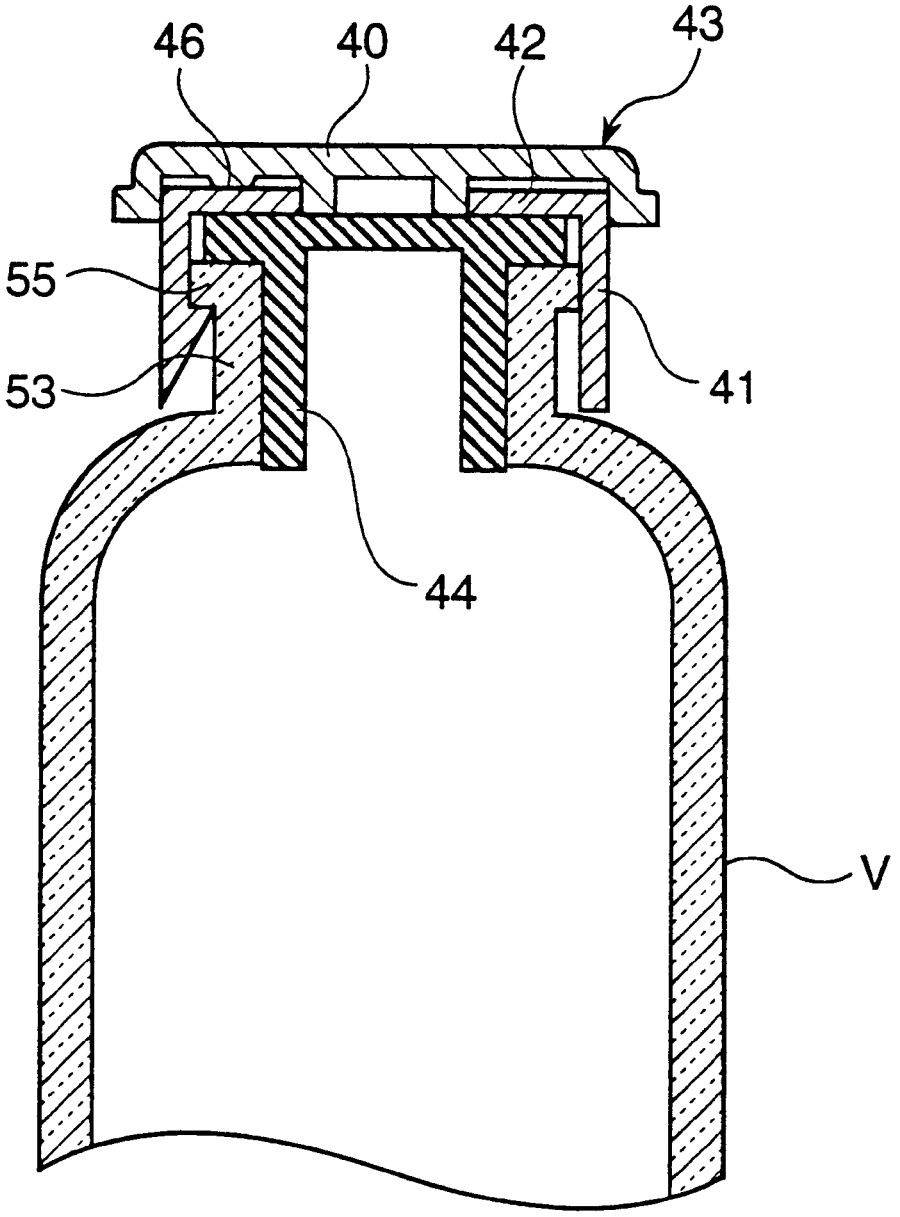
FIG. 11 is a cross-sectional view of a part of a container in the vicinity of the mouth portion thereof, to which the cap unit shown in FIG. 10 is fitted.
Figure 12:
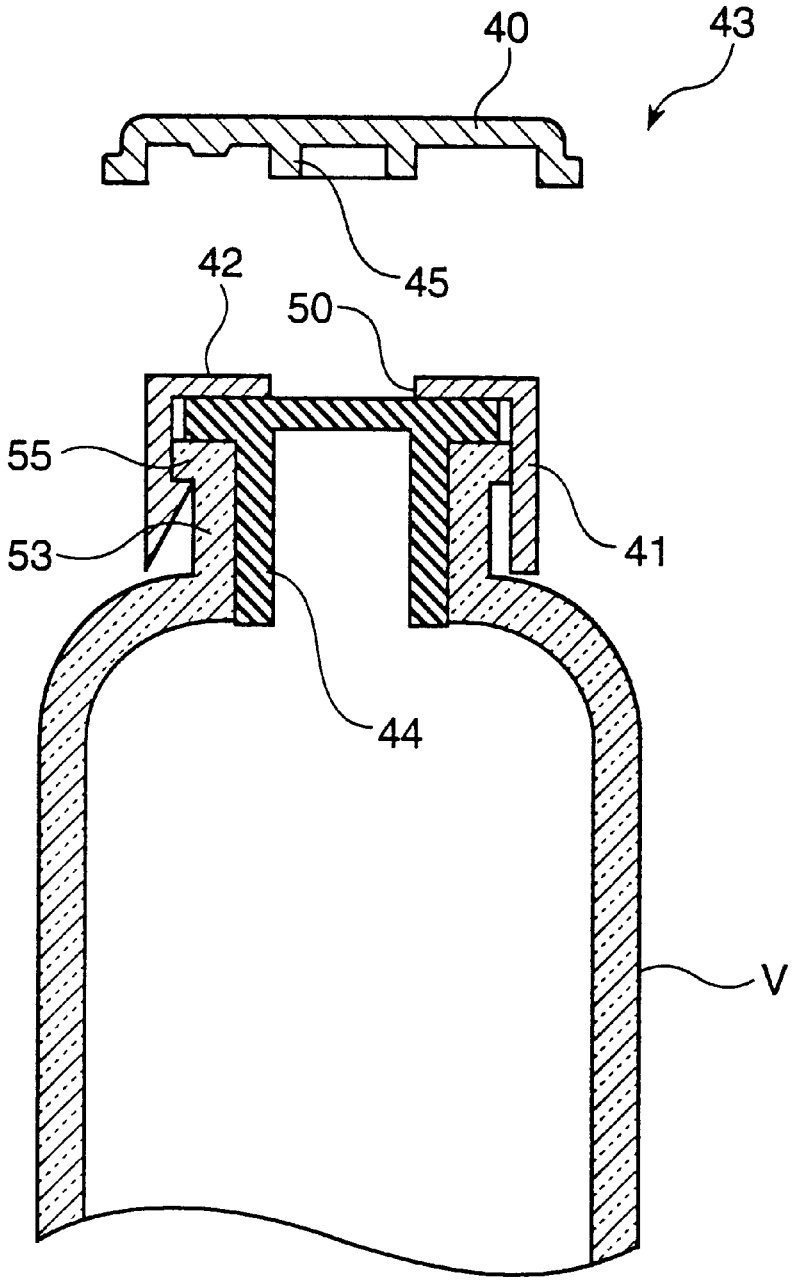
FIG. 12 is a cross-sectional view of the container shown in FIG. 11 from which the closing body is removed.
Figure 13:
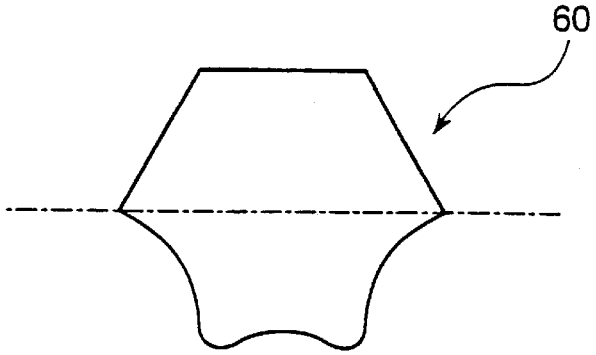
FIG. 13 is a schematic top plan view showing a closing body as shown in FIG. 8 having a shape other than that shown in FIG. 8.

FIG. 8(A) is a bottom plan view of a closing body 40 formed from a thermoplastic resin, and FIG. 8(B) is a cross-sectional view of the closing body taken along line A—A in FIG. 8(A). FIGS. 9(A) and 9(B) are, respectively, a perspective view and a bottom plan view of the crown-like member 41 to which the closing body 40 as shown in FIGS. 8(A) and 8(B) is united by, for instance, ultrasonic welding. FIG. 10 is a cross-sectional view of a cap unit 43 which is united to the top board 42 of the crown-like member 41 at an appropriate strength; FIG. 11 is a schematic vertical section showing a condition where the cap unit 43 is fitted to a drug-container V through a rubber plug 44. FIG. 12 is a schematic vertical section showing the cap unit 43 fitted to a drug-container V from which a closing body 40 is removed. In such a situation, the drug is taken out of the container using, for instance, a needle of a syringe. FIG. 13 is a schematic top plan view showing a closing body having another shape.

An internal annular protrusion 45 is formed on the closing body 40 near the center of the body and a plurality of projections 46 for welding are formed and arranged on the body along an approximate circumference which surrounds the exterior of the internal annular protrusion 45. Moreover, a peripheral annular protrusion 47 is formed on the outer peripheral edge of the body 40. If a reinforcing projection 48 is further formed, it is formed on or along an approximate circular arc which connects any two neighboring projections 46 for welding or on the region which communicates the annular protrusion 45 and the annular protrusion 47 through any projection 46 for welding.

In FIG. 8(A), three projections 46 for welding are protruded from the lower surface 49 of the closing body 40. It is sufficient for these projections 46 for welding to have a height from the lower surface 49 ranging from 0.3 to 2 mm, preferably 0.5 to 1 mm. The shape of the projections 46 for welding is not restricted to any specific one and may be spot-like, so-called projected stripe-like, i.e., like a mountain chain which extends towards one direction, or ring-like. In case of the projected ridge, it may extend in a direction approximately parallel to the circumference or in the radial direction or it may be a combination thereof such as L-shaped. In any case, the tip thereof to be welded is preferably finer or thinner than the base portion thereof. This accordingly makes the welding easier and the welded portion can easily be peeled off.

In most of the cases wherein the projection 46 for welding has a spot-like or ring-like shape, the projection preferably has a height falling within the range defined above and an average diameter ranging from about 0.3 to 1 mm, and more preferably about 0.5 to 0.7 mm. When the projection has a projected ridge-like shape, the projection preferably has a height falling within the range defined above and a length ranging from about 2 to 5 mm and more preferably about 0.3 to 1 mm. In this respect, it is a matter of course that the length, width or the like of the projection 46 for welding are appropriately selected depending on the characteristic properties of each specific material to be welded.

Figure 9:
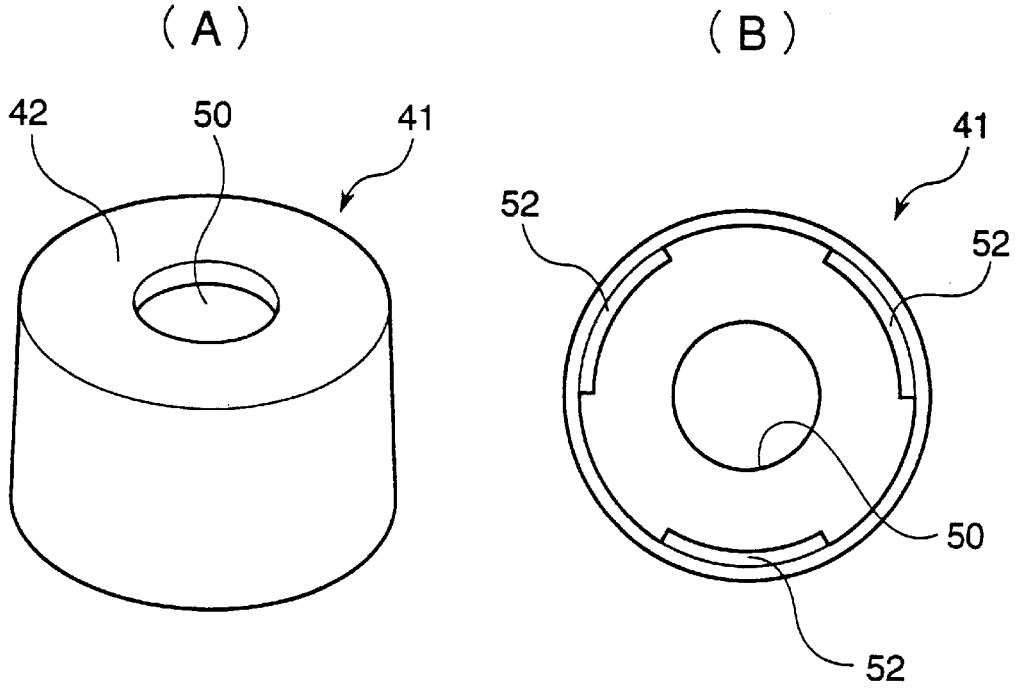
FIG. 9(A) is a perspective view of the crown-like member according to the fourth embodiment and FIG. 9(B) is a bottom plan view of the crown-like member.

Such a projection 46 for welding is welded to the upper surface 42 of the crown-like member 41 made from a resin as shown in FIG. 9 in accordance with the method as will be detailed below. The overall tensile strength observed at the welded portion in general ranges from 0.5 to 3 kgf, preferably 0.5 to 2 kgf.

The term "overall tensile strength" used herein means the tensile stress obtained as a product of each tensile stress generated on each projection 46 for welding and the number of the projections 46 which simultaneously generate tensile stresses during the operation for separating the closing body 40 [=(tensile stress per projection)×(number of projections)].

For this reason, the pushing up force by a thumb observed when three projections 46 for welding are present is in general simultaneously applied to two out of these three projections 46 and therefore, it is expected that the tensile strength required for each projection for welding is about ½ time the desired level.

The projection 46 for welding must satisfy not only the aforementioned requirements, but also those listed below:

i) The projection must be able to be welded by high-frequency welding, in particular, ultrasonic welding technique within a very short time period, in particular, within a time of almost not more than one second;

ii) The welded closing body scarcely causes accidental separation during transportation and storage; and iii) The closing body can relatively easily be removed with fingers upon practical use thereof.

In FIG. 8(A), it is preferred that an internal annular projected ridge 45 be positioned near the center of the closing body 40 and that the outer diameter thereof approaches the inner diameter of the central hole 50 of the crown-like member 41, as shown in FIG. 9, as close as possible. The purpose of this is to isolate the central hole 50 provided near the center of the upper surface of the crown-like member 41 shown in FIG. 9(A) from the outside to the highest possible level. More specifically, the purpose is to protect the rubber plug 44 shown in FIG. 11 from any contamination.

Three projections 46 for welding are protruded from the lower surface 49 of the closing body 40. These projections 46 for welding each has a height, from the lower surface 49 of the closing body 40, of about 0.5 mm and the shape thereof is a trapezoid (truncated cone) which rises from the lower surface 49.

When the projection 46 for welding has, in particular, a spot-like shape, a reinforcing projected ridge 48 may be formed as described above. The reinforcing projected ridge 48 may be provided in the radial direction from the center of the closing body 40 or those approximately parallel to the circumference of the closing body 40.

When the reinforcing projected ridge 48 is radially arranged, the welded closing body 40 is favorably removed by a method which comprises the step of peeling it along the direction from the periphery to the center thereof. This is effective for avoiding such an unexpected accident that the formation of a crack on the closing body 40 which is exclusively parallel to the circumferential direction, as a result of such a situation that after the projection 46 for welding near the outer periphery of the lower surface of the closing body 40 is peeled off, the projection 46 positioned on the inside thereof cannot be peeled off.

On the other hand, the embodiment wherein the reinforcing projected ridge 48 is arranged approximately parallel to the circumferential direction is favorable for the process in which the projection 46 for welding is twisted off by rotating the welded closing body 40 in the direction parallel to the circumference. This is effective for avoiding such an unexpected accident that the formation of a crack on the closing body 40 which is exclusively developed in the radial direction, as a result of such a situation that after one of the projections 46 for welding approximately arranged on the same circumference on the closing body 40 is twisted off, another projection 46 arranged on the same circumference cannot be twisted off.

The number of projections 46 for welding which stand up from the lower surface of the closing body 40 suitably ranges from 3 to 8. It is in general 3 or 4 or at most 6.

FIG. 13 shows a closing body 60 having another external shape. The upper half of FIG. 13 shows an embodiment of the closing body 60 which has a hexagonal external shape. In this case, the hexagon is preferably finished so as to have rounded vertices. On the other hand, the lower half of FIG. 13 shows an embodiment wherein each side of the closing body 60 curves in towards the center thereof. In this case, the hexagon is likewise preferably finished so as to have rounded vertices. As described above, the shape of the foregoing closing body is not limited to being circular and may be polygonal.

As shown in FIGS. 9(A) and 9(B), the crown-like member 41 is a cylindrical body having a lower open end and also having a central hole 50 formed on the center of the top board 42. In addition, three rib-like projections 52 are formed on the inner periphery thereof at predetermined spaces.

The foregoing closing body 40 is united with such a crown-like member 41 to form a cap unit 43 by welding the former to the top board 42 of the latter by any proper means for welding.

As shown in FIG. 11, the cap unit 43 thus united is fitted to the mouth portion 53 of a drug container V in the following manner. First of all, a rubber plug 44 is inserted into the mouth portion 53 of a drug container V. Then the cap unit 43 is put on the mouth portion 53 so as to cover the outer periphery of the portion 53 and is subsequently downward pressed strongly. Thus, the rib-like projections 52 formed on the inner periphery of the crown-like member 41 move down while riding across the flange 55 positioned on the mouth portion of the container V and as a result, the cap unit 43 is fitted to the mouth portion of the container V.

If the liquid drug is practically taken out of the container V which keeps the liquid drug, the closing body 40 can be removed from the crown-like member 41, as shown in FIG. 12, by lightly picking up the body 40 between fingers or by rotating the body 40 in the right and left directions. Under such a condition, the liquid drug can be withdrawn from the container by penetrating a needle of a syringe into the container through the rubber plug 44.

Figure 14:
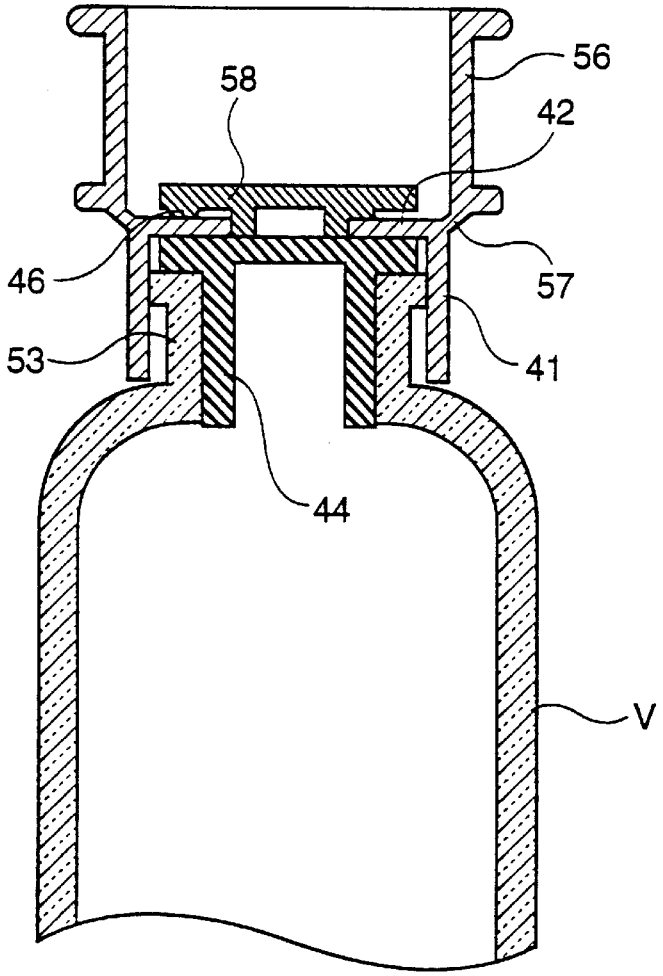
FIG. 14 is a cross-sectional view of a part of a container in the vicinity of the mouth portion thereof, which is provided with a crown cap according to a fifth embodiment of the present invention.

It is also possible to provide a close-fastening ring 56 on the top board 42 of the crown-like member 41 as shown in FIG. 14 so that the cap unit 43 is reliably fitted to the drug container V and the cap unit 43 is never disconnected from the container V even after a long time period. In this case, the close-fastening ring is detachably connected to the crown-like member 41 through a thin portion 57.

When providing such a close-fastening ring 56, it is necessary to reduce the outer diameter of the closing body 58 to a level of less than the diameter of the crown-like member 41.

Then the close-fastening ring 56 which is in the condition as shown in FIG. 14 is pushed down to thus cut the thin portion 57. Thus, the close-fastening ring 56 can closely be fitted to the outer periphery of the crown-like member 41.

In this case, longitudinal slits are formed on the periphery of the crown-like member 41 like the foregoing embodiment.

<<Materials for Closing Body, Crown-Like Member and Close-Fastening Ring>>

Both of the materials for the closing body and the crown-like member must be resins capable of being welded by high-frequency welding, in particular, ultrasonic welding. The term "resin(s)" used herein means not only crystalline resins, but also all of the polymers including so-called glassy polymers, which are usually regarded as "resins" in the field of molding and which are circulated.

Resins satisfying this requirement are thermoplastic resins and have appropriate melt viscosities. Those having such properties are resins constituted by molecules containing polar elements (electro-negative element) in the molecules. From such a viewpoint, the usual polyolefin polymers are in general undesirable as such materials.

More specifically, this is because, in an original sense, the polyolefin polymers do not comprise, in their repeating units, any polar element such as nitrogen, oxygen and/or halogen atoms. For this reason, modified polyolefin polymers are not necessarily excluded. In other words, these modified polyolefin polymers may optionally contain polar copolymer units to such an extent that they can be welded by the high-frequency welding method, in particular, the ultrasonic welding technique.

The thermoplastic resins for forming the closing body 40, 58, the crown-like member 41 and the close-fastening ring 56 are those comprising, in their repeating units, at least one electro-negative element selected from nitrogen, oxygen and halogen atoms. Halogen atom-containing resins which may be put into practical use are chlorine and/or fluorine atom-containing resins.

Examples of such thermoplastic resins include polyamide resins (nylons), thermoplastic polyesters, polyvinyl chloride, polyvinylidene chloride, polycarbonates, resins prepared from (meth)acrylic acids or esters or salts thereof, polysulfones, polyisocyanates (polyurethanes), urea resins, polyphenylene ethers (abbreviation: PPE), polyacetals and alicyclic condensed ring-containing resins.

The foregoing closing body 40, 58, crown-like member 41, close-fastening ring 56 and container V are not necessarily formed from resins of the same kind, but each may be formed from an optimum resin. In practice, however, the closing body 40, 58, the crown-like member 41 and the close-fastening ring 56 are formed from resins of the same kind in most cases. The term "resins of the same kind"

herein used means resins comprising repeating units common to one another.

This is because these resins can be melt-bonded to one another. In other words, these resins must be compatible with one another when they are melted and they must still hold their compatibility with one another even at ordinary temperatures. Resins different from one another may not easily be melt-bonded together. For instance, widely used polyolefin and polyamide resins which are melt-bonded easily cause delamination when only a slight external force is applied thereto at ordinary temperature.

Among the foregoing satisfactory resins, particularly practicable examples thereof will be further detailed below:

i) Polyamide resins (nylons) such as 6-nylon, 6,6-nylon (66-nylon), meta-xylylenediamine-aliphatic dicarboxylic acid polycondensation resins, in particular, meta-xylylenediamine-adipic acid polycondensation resins (abbreviation: MXD6);

ii) Thermoplastic polyesters such as polyethylene terephthalate (PET) and polybutylene terephthalate (PBT);

iii) Polycarbonate (PC), which is the general term of the polycondensation resins of bisphenol derivatives and carbonate derivatives. Widely used examples thereof in general include polycondensation resins of 2,2-propylidene-bis(4-oxyphenyl) propane (common name: bisphenol A) derivatives such as sodium salt with acid chlorides of carbonic acid such as phosgene. Widely used examples thereof further include, in addition to the foregoing examples, polycarbonates obtained using the following compounds as the bisphenol A:

Methylenebis(4-oxyphenyl)(common name: bisphenol F);

2,2-ethylidenebis(4-oxyphenyl)ethane;

2,2-butylidenebis(4-oxyphenyl)butane, or the like.

vi) Alicyclic condensed ring-containing resins such as resins obtained by hydrogenation-ring opening polymerization of norbornenes; polycyclopolyenes, in particular, addition-polymerization resins of tricyclodecenes or copolymer resins of tricyclodecenes with 1-olefins, usually ethylene.

Various thermoplastic resins such as those listed above may be used, but the closing body 40, 58, the crown-like member 41 and the close-fastening ring 56 are preferably formed from the same thermoplastic resin (thermoplastic polymer). An example of such resin preferably used herein is a polycarbonate (PC), a polyethylene terephthalate (PET) or a polybutylene terephthalate (PBT).

<<Means for Welding>>

As means for welding the resin projection 46 for welding which stands up from the lower surface 49 of the closing body 40 according to the embodiment to the resin top board 42 of the crown-like member 41, preferred are high-frequency welding techniques, in particular, ultrasonic welding. This is because this welding technique can weld within a quite short time period, for instance, 0.2 to 0.5 sec and can weld at the desirebly small area (i.e., the welding technique permits spot-welding).

More specifically, when subjecting the once molded closing body 40 and crown-like member 41 to a working step such as an assembly line operation which allows the subject to be welded to stay therein only a very short time period, the welding technique to be selected should be one which permits the welding operation within a time as short as possible without adversely affecting the parts which are not concerned in the welding operation.

Among welding techniques which make use of high frequency waves, ultrasonic welding techniques are practical. Moreover, welding techniques using electromagnetic waves such as microwaves are also useful. These welding techniques may appropriately be selected and used depending on the subject to be welded.

As has been described above, the use of the closing body provided with such projections for welding permits the achievement of the following various effects.

(1) The problem concerning the contamination of the exposed portion of the rubber plug arises when a metal cap is replaced with one made of a resin, but the problem can effectively be solved by fitting a closing body to the exposed portion.

(2) The closing body thus fitted hardly causes any spontaneous disconnection during handling, but may relatively easily be removed by hand or with fingers prior to the use of a drug kept in the container.

(3) The additional welding step permits the welding of desired positions of the closing body to the crown-like member at an overall tensile strength of not more than about 2 kgf within a very short period of time.

(4) Even in the existing working process, the step of welding the closing body can easily be added to the process without any particular change in the existing procedures.

EXAMPLES

Specific Examples of the present invention will hereinafter be described.

Example 1

A container V for injections which satisfied the requirements for the Vial No. 1 defined in JIS R3521 was prepared using a tricyclodecene derivative (available from Mitsui Petrochemical Industries, Ltd. under the trade name of APEL 6015) having a condensed polycyclic structure. A drug for testing was introduced into the resulting container V. A desired rubber plug (which had been sterilized) was fitted to the mouth portion of the container while suspending the plug about 4 mm above the mouth portion (half-plugged condition). Lyopholizing was then performed in a freeze dryer at a temperature of −40° C. The container was completely plugged of the with the rubber plug and then withdrawn from the freeze dryer.

Then, a cap unit 43 of an integral structure was externally engaged with and fitted to the peripheral edge of the mouth portion of the container V. This cap unit 43 of an integral structure was made of a polycarbonate and a closing body 40 was welded and bonded to the upper surface of a crown-like member 41 through three projections 46 for welding which had been formed on the lower surface of the body 40 by supplying ultrasonic waves ($2\times10^3$ Hz; 0.15 sec) to the projections 46 through the upper surface of the body 40 using an ultrasolic welding device (available from BRANSON Company under the trade name of 910IW) so that the tips of the projections 46 were welded to a top board 42 of the crown-like member 41 at a lowest required level of strength. The strength required for the welding and bonding herein means that required for the closing body 40 so as not to cause separation even when spontaneously dropping, from a height of 1 m, the vial No. 1 (V) for injection which had been filled with the contents and provided with the fused closing body 40.

The resulting cap unit 43 did not cause any spontaneous dropping of the closing body 40 during the manual handling thereof. For this reason, there was not observed any contact of the rubber plug portion on the upper surface of the container V and the mouth-peripheral portion thereof with fingers and hands due to unconscious behaviors.

The closing body 40 had to be removed prior to the practical use of the injection kept in the vial container V. However, the closing body 40 could safely and rapidly be separated from the cap unit by hand or with a finger without using any particular tool.

As described above in detail, the crown cap according to the present invention ensures a high fastening or tightening force since the close-fastening ring which is usually positioned upward and subsequently closely fastened to the outer periphery of the crown-like member strongly and inwardly presses the crown-like member through the outer periphery of the mouth portion of the container. Moreover, the close fastening ring locks the crown-like member while the former strongly presses the crown-like member in upward and downward directions and accordingly, the opening of the mouth portion of the container can closely be sealed even if a plate-like rubber gasket is used. For this reason, it is not necessary even for a rubber gasket provided with a cylindrical portion to press the cylindrical portion into the mouth portion of the container to a substantial depth and this in turn prevents any release of additives incorporated into the rubber, any generation of rubber waste and any absorption and/or adsorption of drug components in the drug solution on the rubber plug. Furthermore, the opening can easily be exposed to allow penetration, for instance, of needles, i.e., the crown cap can conveniently be used. In addition, the crown cap can be half-plugged and therefore, can be used in lyophilization.

The crown cap of the present invention may completely be prepared from combustible materials and accordingly, can be disposed as a complete combustible substance without any classification.

What is claimed is:

1. A crown cap which comprises a close-fastening ring integrally separably formed on an upper portion of a crown/member comprising a cylindrical body which is fitted to a mouth portion of a container while surrounding a periphery of the mouth portion and having a diameter slightly greater than that of the crown/member and which is used in such a manner that a close-fastening ring is detached from the crown/member and put on an outer periphery of the crown/member by pressing the ring towards a side of the crown/member to thus closely fit the crown/member to the mouth portion of the container, wherein an opening is preliminarily formed through a top board of the crown/member, a removable closing body is fitted to the opening, the opening is exposed on the top board of the crown/member by disconnecting the closing body, and a plurality of projections for welding are formed on a lower surface of the closing body and the closing body is welded, through the projections, to the board of the crown/member at a strength ranging from 0.5 to 3 kgf as expressed in terms of an overall tensile strength.

2. The crown cap of claim 1 wherein the closing body comprises an elongated rod-shaped body which is removably fitted to an inner wall of the opening and stands up from the opening.

3. The crown cap of claim 1 wherein the closing body comprises a flat portion which is supported by and fitted to the opening and a finger-hook ring which can be pulled to remove the closing body.

4. The crown cap of claim 1 wherein an overall basal area of the plurality of projections for welding ranges from 0.4 to 2 $mm^2$.

5. The crown cap of claim 1 wherein the closing body, the crown/member, and the close-fastening ring are formed from a thermoplastic resin.

6. The crown cap of claim 1 wherein the closing body, the crown/member, and the close-fastening ring are formed from at least one resin selected from polycarbonates, polyethylene terephthalates, and polybutylene terephthalates.

7. A crown cap which comprises a close-fastening ring integrally separably formed on an upper portion of a crown/member which is fitted to a mouth portion of a container while surrounding a periphery of the mouth portion and having a diameter slightly greater than that of the crown/member and which is used in such a manner that the close-fastening ring is detached from the crown/member and put on an outer periphery of the crown/member by pressing the ring towards a side of the crown/member to thus closely fit the crown/member to the mouth portion of the container, wherein a rubber gasket seals an opening of the mouth portion;

fixing means are disposed between the crown/member and the rubber gasket for preventing separation of the rubber gasket from the mouth portion, and a plurality of projections for welding are formed on a lower surface of the closing body and the closing body is welded, through the projections, to a top board of the crown/member at a strength ranging from 0.5 to 3 kgf as expressed in terms of an overall tensile strength, the overall basal area of the plurality of the projections for welding ranging from 0.4 to 2 $mm^2$.

8. The crown cap of claim 7 wherein the fixing means comprises projections protruded from an inner periphery of the crown/member.

9. The crown cap of claim 7 wherein the fixing means comprises an adhesive layer which lies between the rubber gasket and the top board of the crown/member.

10. The crown cap of claim 7 wherein the closing body, the crown/member, and the close-fastening ring are formed from a thermoplastic resin.

11. The crown cap of claim 7 wherein the closing body, the crown/member, and the close-fastening ring are formed from at least one resin selected from polycarbonates, polyethylene terephthalates, and polybutylene terephthalates.

* * * * *

UNITED STATES PATENT AND TRADEMARK OFFICE

CERTIFICATE OF CORRECTION

PATENT NO. : 5,957,314
DATED : September 28, 1999
INVENTOR(S) : NISHIDA et al.

It is certified that error appears in the above-identified patent and that said Letters Patent is hereby corrected as shown below:

Column 13, lines 35 and 36, change "crown/" to --crown--;

line 39, change "crown/" to --crown--;

line 41, change "crown/" to --crown--;

lines 41 and 42, change "crown/" to --crown--;

lines 42 and 43, change "crown/" to --crown--;

line 43, change "crown/" to --crown--;

line 46, change "crown/" to --crown--;

line 48, change "crown/" to --crown--;

line 53, change "crown/" to --crown--;

Column 14, line 12, change "crown/" to --crown--;

line 15, change "crown/" to --crown--;

lines 19 and 20, change "crown/" to --crown--;

lines 22 and 23, change "crown/" to --crown--;

UNITED STATES PATENT AND TRADEMARK OFFICE

CERTIFICATE OF CORRECTION

PATENT NO. : 5,957,314

DATED : September 28, 1999

INVENTOR(S) : NISHIDA et al.

It is certified that error appears in the above-identified patent and that said Letters Patent is hereby corrected as shown below:

line 25, change "crown/" to --crown--;

line 26, change "crown/" to --crown--;

line 27, change "crown/" to --crown--;

line 30, change "crown/" to --crown--;

line 36, change "crown/" to --crown--;

line 42, change "crown/" to --crown--;

line 45, change "crown/" to --crown--;

line 47, change "crown/" to --crown--;

line 50, change "crown/" to --crown--;

Signed and Sealed this

Twenty-seventh Day of June, 2000

*Attest:*

Q. TODD DICKINSON

*Attesting Officer*

*Director of Patents and Trademarks*